US008193884B2

(12) United States Patent
Chiesi et al.

(10) Patent No.: US 8,193,884 B2
(45) Date of Patent: Jun. 5, 2012

(54) SWITCHING DEVICE INCLUDING A MOVING FERROMAGNETIC PART

(75) Inventors: Laurent Chiesi, Reaumont (FR); Benoit Grappe, Saint Egreve (FR); Mathias Lamien, Colombe (FR); Sylvain Paineau, Voiron (FR)

(73) Assignee: Schneider Electric Industries SAS, Rueil-Malmaison (FR)

( * ) Notice: Subject to any disclaimer, the term of this patent is extended or adjusted under 35 U.S.C. 154(b) by 303 days.

(21) Appl. No.: 12/373,372

(22) PCT Filed: Jul. 2, 2007

(86) PCT No.: PCT/EP2007/056641

§ 371 (c)(1),
(2), (4) Date: Jan. 12, 2009

(87) PCT Pub. No.: WO2008/006729

PCT Pub. Date: Jan. 17, 2008

(65) Prior Publication Data

US 2009/0302981 A1 Dec. 10, 2009

(30) Foreign Application Priority Data

Jul. 12, 2006 (FR) ..... 06 52935

(51) Int. Cl.
*H01H 9/00* (2006.01)

(52) U.S. Cl. ..... 335/205; 335/78

(58) Field of Classification Search ..... 335/78, 335/205–207, 302–306; 200/181
See application file for complete search history.

(56) References Cited

U.S. PATENT DOCUMENTS

| | | | | |
|---|---|---|---|---|
| 4,150,350 | A * | 4/1979 | Fong | 335/205 |
| 4,271,763 | A * | 6/1981 | Berger | 104/179 |
| 5,233,322 | A | 8/1993 | Posey | |
| 5,293,523 | A | 3/1994 | Posey | |
| 6,016,092 | A * | 1/2000 | Qiu et al. | 333/262 |
| 6,060,969 | A * | 5/2000 | Hufgard et al. | 335/207 |
| 6,094,116 | A * | 7/2000 | Tai et al. | 335/78 |
| 6,310,526 | B1 * | 10/2001 | Yip et al. | 333/262 |
| 6,320,145 | B1 * | 11/2001 | Tai et al. | 200/181 |
| 7,420,447 | B2 * | 9/2008 | Ruan et al. | 335/78 |
| 7,750,771 | B2 * | 7/2010 | Yamada et al. | 335/205 |
| 2007/0231944 | A1 * | 10/2007 | Kvisteroy | 438/52 |

FOREIGN PATENT DOCUMENTS

WO 2004 066330 8/2004

OTHER PUBLICATIONS

U.S. Appl. No. 12/302,838, filed Nov. 28, 2008, Chiesi, et al.

* cited by examiner

*Primary Examiner* — Bernard Rojas
(74) *Attorney, Agent, or Firm* — Oblon, Spivak, McClelland, Maier & Neustadt, L.L.P.

(57) ABSTRACT

An electrical switching device that can be employed in a sliding button, a rotating button, in a position switch, or an impact sensor. This device includes: a permanent magnet creating a magnetic field and a microswitch controlled between at least two states, by being aligned along two different orientations of field lines of the magnetic field of the permanent magnet. The microswitch and the permanent magnet are fixed relative to one another and a movable ferromagnetic part is moved between two positions so as to act on the orientation of the field lines generated by the permanent magnet so as to impose on the microswitch one or other of its two states.

15 Claims, 3 Drawing Sheets

SWITCHING DEVICE INCLUDING A MOVING FERROMAGNETIC PART

Figure 1:
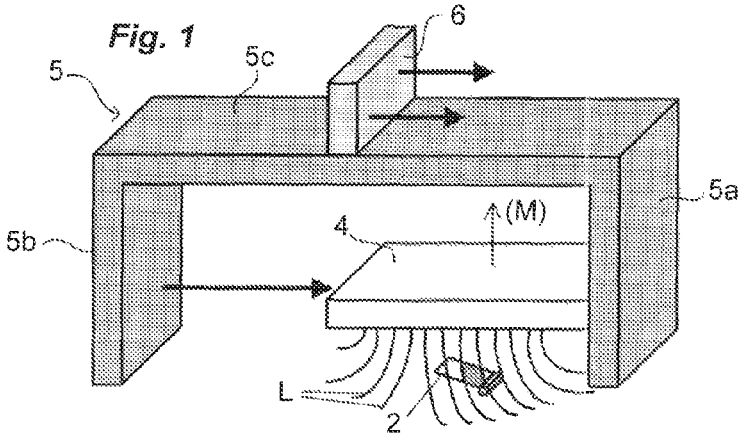

The present invention relates to an electrical switching device comprising a magnetic microswitch provided with a moving element able to be aligned according to the field lines of a magnetic field. The switching device according to the invention can in particular be used in a pushbutton, a slide button or a rotary knob, in a position switch, an impact sensor or an acceleration sensor.

A position sensor comprising a magnetic microswitch provided with a moving element driven by magnetic effect by a moving permanent magnet is known from U.S. Pat. No. 6,633,158. The permanent magnet can assume at least two positions to submit the moving element to the two orientations of its field lines. By being aligned on the field lines of the permanent magnet, the moving element switches over between an open state or a closed state respectively corresponding to the opening or the closure of an electrical circuit. These magnetic microswitches sensitive to the orientation of the field lines react very precisely to the position of the permanent magnet. They are therefore difficult to adjust when assembling the detector.

The documents WO2004/066330 and U.S. Pat. No. 5,923,523 describe position sensors that employ inaccurate "reed" type switches, switched by the displacement of a ferromagnetic part close to a fixed magnet. In the first document, the ferromagnetic part is moved by a fluid. Its displacement is therefore not calibrated.

The aim of the invention is to propose an electrical switching device provided with a magnetic microswitch, the adjustment of which on assembly is easy and whose performance characteristics are unaffected over time, said device being accurate and perfectly calibrated to be triggered systematically when a force of determined intensity is applied.

This aim is achieved by an electrical switching device comprising:

- a permanent magnet creating a magnetic field,
- an electrical microswitch provided with a moving element driven by a magnetic effect between at least two states by being aligned according to two different orientations of the field lines of the magnetic field of the permanent magnet, characterized in that:
- the microswitch and the permanent magnet are fixed relative to each other,
- the device comprises a moving ferromagnetic part that is moved between two positions to act on the orientation of the field lines generated with respect to the moving element by the permanent magnet in order to impose on the moving element one or other of its two states,
- in the initial position, the ferromagnetic part is maintained by magnetic effect against the permanent magnet.

According to the invention, employing a permanent magnet and a microswitch that are fixed relative to each other makes it possible to limit the constraints on adjusting the operating points of the microswitch relative to the permanent magnet and therefore to overcome the problems of assembling the permanent magnet/microswitch pairing.

According to the invention, the permanent magnet is therefore used both to retain the ferromagnetic part in the initial position but also to switch the microswitch when the ferromagnetic part is moved.

According to a particular feature of the invention, the moving ferromagnetic part follows a translation movement. The translation movement is, for example, perpendicular to a direction of magnetization of the permanent magnet.

According to the invention, the microswitch is, for example, centred relative to the permanent magnet. Thus, without the influence of the ferromagnetic part, the moving element is in a rest state situated between its open state and its closed state. By centering the microswitch relative to the permanent magnet, the ferromagnetic part can be symmetrical and act, in each of its positions, symmetrically on the field lines of the permanent magnet.

According to another particular feature, in each of its positions, the ferromagnetic part is maintained by a magnetic attraction effect exerted by the permanent magnet.

According to another particular feature, the ferromagnetic part has a U-shape comprising a central part and two parallel wings between which the permanent magnet is positioned. In each of the positions of the ferromagnetic part, one of its wings is attracted by the permanent magnet. The architecture of the invention is therefore particularly compact, in particular thanks to the dual function of the magnet that makes it possible to both switch the microswitch and hold the ferromagnetic part in its initial position, and, where appropriate, depending on the configuration, in its final position.

According to the invention, the microswitch is, for example, off-centred relative to the permanent magnet. Without the influence of the ferromagnetic part, the microswitch is therefore maintained by magnetic effect in one of its open or closed states. The ferromagnetic part can therefore assume a first extreme position in which it deflects the field lines to impose on the moving element the other of its two states and a second distant extreme position in which it does not act on the field lines. The first extreme position is stable, the ferromagnetic part being maintained by magnetic attraction effect exerted by the permanent magnet and the second extreme position of the ferromagnetic part is ephemeral, marked by an end-stop. In the second extreme position, the ferromagnetic part remains under the magnetic influence of the permanent magnet so as to be returned by magnetic effect to the first position.

According to an embodiment variant of the device, the permanent magnet is in the form of a disk and the moving ferromagnetic part has the shape of a rotating ring encircling the permanent magnet and performing a rotation movement about the permanent magnet. The ring presents, for example, a protuberance able to assume two diametrically opposed positions to act on the field lines either side of a plane of symmetry.

The inventive switching device is, for example, employed in a pushbutton, a slide button, a position switch, an impact sensor or an acceleration sensor.

Figure 2:
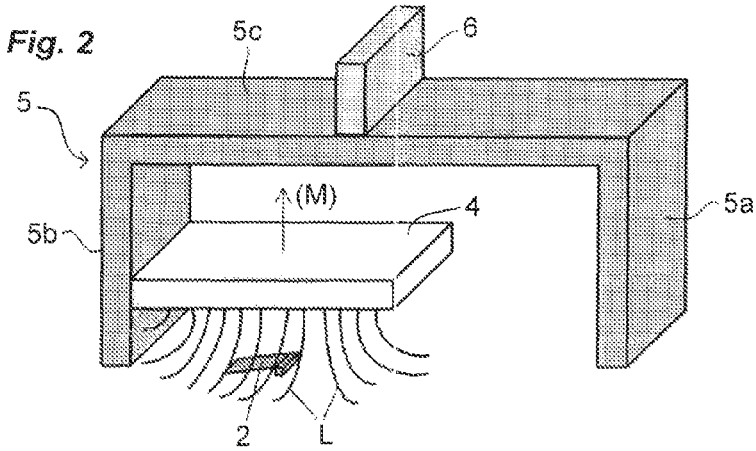
Figure 3:
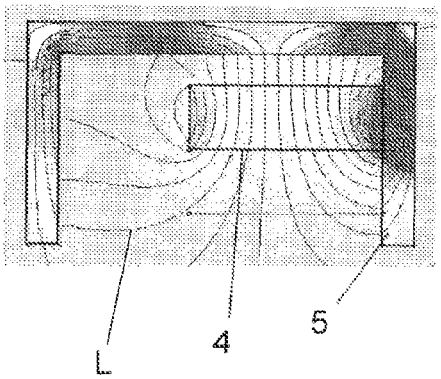
Figure 4:
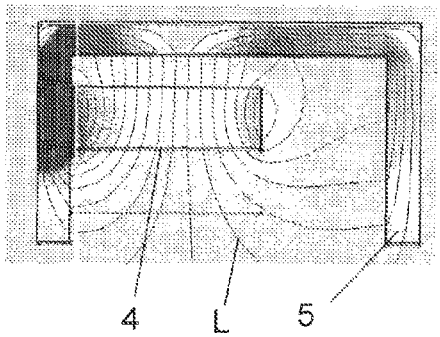
Figure 5:
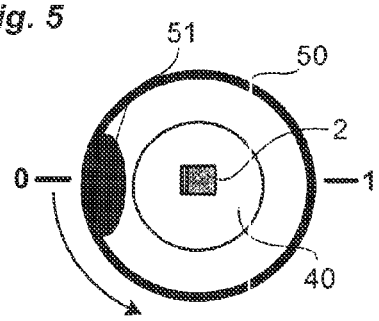
Figure 6:
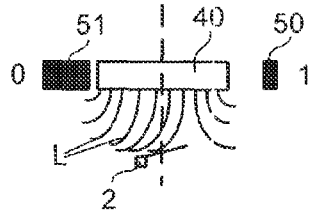
Figure 7:
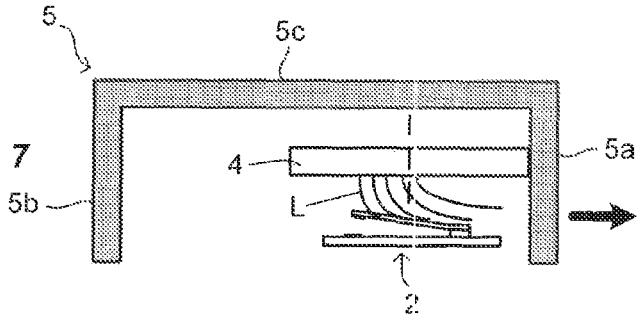
Figure 8:
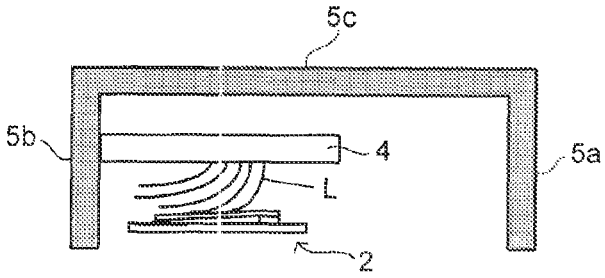
Figure 9:
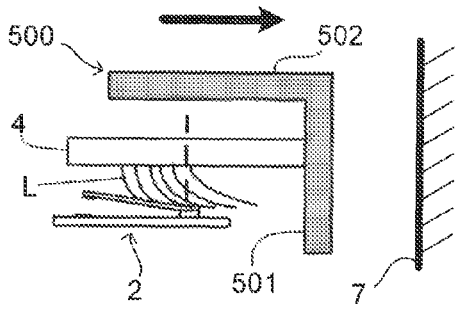
Figure 10:
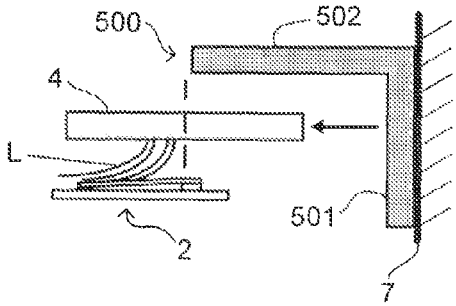
Figure 11:
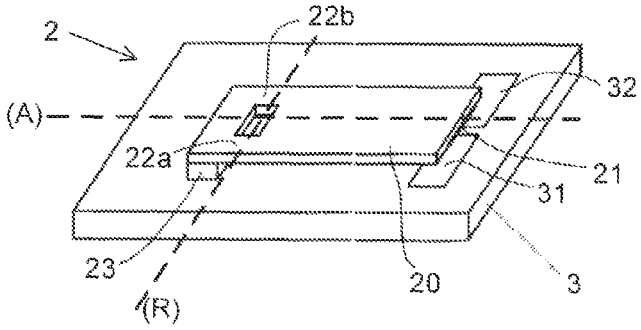
Figure 12:
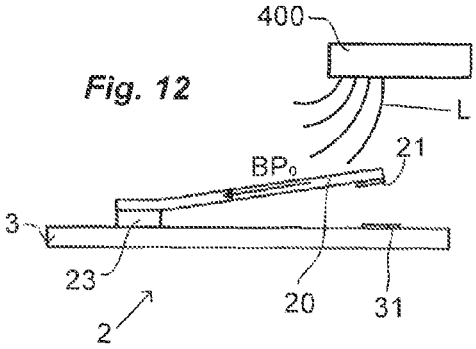
Figure 13:
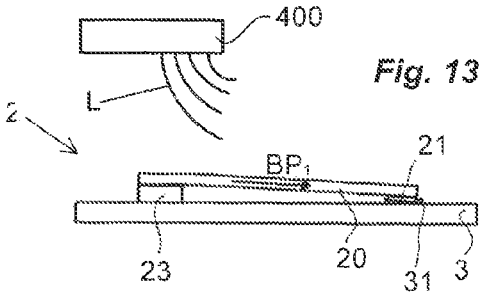

Other characteristics and advantages will become apparent from the detailed description that follows, referring to an embodiment given by way of example and represented by the appended drawings in which:

FIGS. 1 and 2 represent the inventive switching device, employed in a slide button, respectively in the closed state and in the open state, FIGS. 3 and 4 show the influence of the ferromagnetic part on the magnetic field lines generated by the permanent magnet, FIG. 5 represents the switching device employed in a rotary knob shown diagrammatically, FIG. 6 represents, seen from the side, the rotary knob of FIG. 5, FIGS. 7 and 8 represent the inventive switching device employed in an impact detector, respectively in the rest state and in the triggered state, FIGS. 9 and 10 represent the inventive switching device employed in an impact detector, respectively in the rest state and in the triggered state, FIG. 11 represents a perspective view of a magnetic microswitch as employed in the inventive switching device, FIGS. 12 and 13 represent the microswitch of FIG. 11 respectively in the open state and in the closed state according to the orientation of the field lines generated by a permanent magnet.

The invention relates to a switching device comprising at least one fixed magnetic microswitch 2, a fixed permanent magnet 4, 40 and a moving ferromagnetic part 5, 50, 500.

This switching device can be implemented in a pushbutton, a slide button or a rotary knob, and in a position switch, an impact or acceleration sensor.

The microswitch 2 that is employed is of magnetic type, sensitive to the orientation of the field lines L of a magnetic field generated by a permanent magnet 4.

This type of microswitch 2 can be switched by a permanent magnet between two states, an open state (FIG. 12) and a closed state (FIG. 13). It is, for example, manufactured in MEMS ("Micro-Electro-Mechanical System") technology.

An exemplary configuration of a microswitch 2 sensitive to the orientation of the field lines L is represented in FIGS. 11 to 13.

A microswitch 2 sensitive to the orientation of the field lines L comprises a deformable moving ferromagnetic membrane 20 that can be actuated rotation-wise about an axis of rotation (R) under the influence of the permanent magnet 4. The membrane 20 is, for example, made of iron-nickel.

The membrane 20 presents a longitudinal axis (A) and is linked, at one of its ends, via link arms 22*a*, 22*b*, to one or several anchoring posts 23 attached to a substrate 3. The membrane 20 is able to pivot relative to the substrate according to its axis (R) of rotation perpendicular to its longitudinal axis (A). The link arms 22*a*, 22*b* form an elastic link between the membrane 20 and the anchoring post 23 and are stressed to flex on the pivoting of the membrane 20.

At its distal end relative to its axis of rotation, the membrane 20 supports a moving contact 21. By pivoting, the membrane 20 can assume at least two determined states, an open state (FIG. 12) in which two fixed electrical tracks 31, 32 deposited on the substrate are disconnected or a closed state (FIG. 13) in which the two tracks 31, 32 are interlinked by the moving contact 21 supported by the membrane 20. In FIG. 11, the membrane is in the rest state, in a position parallel to the surface of the substrate 3.

The operating principle of such a microswitch 2 is illustrated in FIGS. 12 and 13. One of the actuation modes of the membrane 20 of such a microswitch 2 consists in applying a magnetic field created by a permanent magnet 400. According to this actuation mode, the ferromagnetic membrane 20 is displaced between its two states by being aligned on the field lines L of the magnetic field generated by the permanent magnet 400. With reference to FIGS. 12 and 13, the magnetic field of the permanent magnet 400 presents field lines L whose orientation generates a magnetic component $BP_0$, $BP_1$ in a ferromagnetic layer of the membrane 20 according to its longitudinal axis (A). This magnetic component $BP_0$, $BP_1$ generated in the membrane 20 generates a magnetic torque forcing the membrane 20 to assume one of its open (FIG. 12) or closed (FIG. 13) states. By displacing the permanent magnet 400 in translation parallel to the longitudinal axis (A) of the membrane 20, it is therefore possible to submit the membrane 20 to two different orientations of the field lines L of the magnetic field of the permanent magnet 400 and cause the membrane 20 to switch over between its two states. The open or closed state of the membrane depends on the position and the orientation of the microswitch 2 relative to the permanent magnet 400.

In the inventive switching device, this principle of actuation of the microswitch 2 is used, except that the permanent magnet 4, 40 employed and the microswitch 2 are both fixed. In order to be able to submit the membrane 20 of the microswitch 2 to the two orientations of the field lines of the magnetic field generated by the permanent magnet 4, 40, a ferromagnetic part 5, 50, 500 is moved between at least two positions close to the permanent magnet 4, 40. By being displaced, this ferromagnetic part 5, 50, 500 has the effect of displacing the plane of symmetry of the field lines L of the magnetic field of the permanent magnet 4, 40 and therefore deflecting the field lines L of the permanent magnet 4, 40.

A slide button provided with a switching device according to the invention is represented in FIGS. 1 and 2. This slide button comprises an actuation unit 6 attached to the ferromagnetic part 5 and that moves in translation in a casing (not represented) according to a translation direction. The ferromagnetic part 5 is symmetrical relative to a vertical plane and for example has an overturned U-shape consisting of two symmetrical parallel lateral wings 5*a*, 5*b* linked to each other by a perpendicular central part 5*c*. The permanent magnet 4 of the device is, for example, of parallelepipedal shape and is placed inside the U formed by the ferromagnetic part 5, between the two wings 5*a*, 5*b* of the part 5. The direction of magnetization (M) of the permanent magnet 4 and the plane of symmetry of the field lines L of the permanent magnet 4 are perpendicular to the translation direction of the moving ferromagnetic part 5. In the appended figures, the translation direction of the ferromagnetic part 5 is, for example, situated in a horizontal plane.

The microswitch 2 is placed under the magnetic influence of the permanent magnet 4, centred relative to the permanent magnet 5, so that, without ferromagnetic part 5, the membrane 20 is parallel to the substrate 3 and is in the rest state (as in FIG. 11). The axis of rotation (R) of the microswitch 2 is horizontal and perpendicular to the translation direction of the ferromagnetic part 5.

According to the invention, the ferromagnetic part 5 is able to be displaced in translation between two extreme positions relative to the fixed permanent magnet 4. In each of its extreme positions, it for example comes to a stop on each of its wings 5*a*, 5*b* against the permanent magnet 4 and is maintained glued by magnetic attraction effect against the permanent magnet 4. A minimal effort must therefore be exerted on the actuation unit 6 to unglue the ferromagnetic part 5 from the permanent magnet 4 and displace it from one position to the other, so conferring on the user a particular tactile effect on the displacement of the actuation unit 6. As the ferromagnetic part 5 is displaced from one position to the other, the magnetic attraction effect is attenuated between a first wing 5*a* of the ferromagnetic part 5 and the permanent magnet 4 and increases between the second wing 5*b* of the ferromagnetic part 5 and the permanent magnet 4.

The effect of the ferromagnetic part 5 is to displace the plane of symmetry of the field lines L of the permanent magnet 4. In each extreme position of the ferromagnetic part 5, field lines L generated by the permanent magnet 4 are thus deflected by the ferromagnetic part 5 so as to submit the membrane 20 of the microswitch 2 to a determined orientation and force it into one of its open or closed states (see FIGS. 3 and 4).

This configuration of the switching device in a slide button is perfectly reproducible in a pushbutton or a position switch, only the orientation of the parts possibly having to be modified.

The switching device according to the invention can also be employed in a rotary knob as represented in FIG. 5. The rotary knob comprises, for example, a permanent magnet 40 in the form of a disc placed, for example, above the microswitch 2. The microswitch 2 and the permanent magnet 40 are fixed relative to each other so that the membrane 20, without the influence of the ferromagnetic part 50, is in the rest state (as in FIG. 11). The ferromagnetic part 50 comprises, for example, a ring encircling the permanent magnet 40 and able to rotate on its axis about the permanent magnet 40 when it is actuated by an external actuation unit that cannot be seen in FIG. 5. The axis of the ring is, for example, vertical, whereas the axis of rotation of the membrane of the microswitch 2 is horizontal. The ring includes an internal protuberance 51 formed in the direction of the permanent magnet 40 and responsible, according to the position of the ring, for deflecting the field lines of the permanent magnet 40. The protuberance 51 of the ring is able to rotate between at least two diametrically opposing positions (1 and 0 in FIGS. 5 and 6) aligned on the longitudinal axis (A) of the membrane 20 of the microswitch so as to deflect on either side the field lines L of the permanent magnet and submit the membrane 20, depending on its position, to one or other of the two orientations of the field lines L. The configuration described hereinabove of the switching device can also be employed in a position switch, an impact or acceleration sensor, the actuation no longer being manual but caused by an external phenomenon.

The inventive switching device can also be employed in an impact sensor or even an acceleration sensor.

In a first configuration represented in FIGS. 7 and 8, the impact sensor has, for example, a switching device similar to that employed in the slide button described hereinabove. The ferromagnetic part 5 is identical and thus has an overturned U-shape provided with two parallel lateral wings 5*a*, 5*b* separated by a perpendicular central part 5*c*. As previously, the permanent magnet 4 and the microswitch 2 are placed in the U formed by the ferromagnetic part 5.

In this first configuration, in the initial position, the first wing 5*a* of the ferromagnetic part is maintained by magnetic effect against the permanent magnet 4 (FIG. 7). On an impact, the ferromagnetic part 5 can be displaced horizontally in a direction towards its second position, from a determined triggering threshold. In its second position, the second wing 5*b* of the ferromagnetic part 5 is pressed by magnetic effect against the permanent magnet 4 (FIG. 8). The triggering threshold of the impact sensor is in particular dependent on the weight of the moving ferromagnetic part 5, on the nature of the materials forming the permanent magnet 4 and the ferromagnetic part 5, on the size of the surface of the permanent magnet 4 situated facing the ferromagnetic part 5, and on the initial air-gap distance separating the distant wing 5*a*, 5*b* of the ferromagnetic part 5 relative to the permanent magnet 4.

In each of its two positions, the ferromagnetic part 5 acts on the orientation of the field lines L of the magnetic field of the permanent magnet 4 so as to deflect them and submit the membrane 20 of the microswitch 2 to a majority orientation of the field lines L. In the initial position of the ferromagnetic part 5, the field lines L seen by the membrane 20 of the microswitch 2 force it to its open state. In the second position of the ferromagnetic part 5, the field lines L seen by the membrane 20 present a reverse orientation and force it to its closed state.

In this first configuration, the ferromagnetic part 5 remains in position glued to the permanent magnet 4 after the actuation of the impact sensor which makes it possible to provide the sensor with a memory effect. In order to favour this memory effect, the two wings 5*a*, 5*b* of the ferromagnetic part 5 can be dimensioned differently to increase the attraction force between the ferromagnetic part 5 and the permanent magnet 4 when the part 5 is in its second position. Similarly, the distance between the permanent magnet 4 and the distant wing 5*a* of the ferromagnetic part 5 after the sensor has been triggered can be adjusted to avoid the return of the ferromagnetic part 5 to the initial position.

In a second configuration of the impact sensor represented in FIGS. 9 and 10, the ferromagnetic part 500 presents, for example, an L configuration with two perpendicular branches 501, 502. The ferromagnetic part 500 can be displaced in translation according to a direction, for example horizontal, under the effect of an impact, between a stable initial position (FIG. 9) in which it is pressed by magnetic effect against the permanent magnet 4 and a second distant position (FIG. 10). One of the branches 501 of the L-shaped ferromagnetic part 500 is perpendicular to its direction of translation and the other branch is parallel to this direction. The second position is marked by a fixed end-stop for example comprising a wall 7 placed on the path of the ferromagnetic part 500. This wall 7 is positioned so as to maintain the ferromagnetic part 500 under the magnetic influence of the permanent magnet 4 regardless of the intensity of the impact, even when the ferromagnetic part 500 comes to a stop against the wall 7. After an impact, the ferromagnetic part 500 is therefore brought automatically by magnetic effect against the permanent magnet 4.

In this second configuration, the microswitch 2 is off-centred relative to the permanent magnet 4 so as to place the membrane 20 in one of its two states, open or closed (closed in FIG. 10) when the ferromagnetic part 500 is in its second position (FIG. 10), that is, when the ferromagnetic part 500 is distant and no longer has an effect on the field lines L of the permanent magnet 4. In the initial position, the ferromagnetic part 500 acts on the field lines L of the permanent magnet 4 and deflects them so as to submit the membrane 20 to a defined orientation and force it to the other of its two states, open or closed (open in FIG. 9).

Obviously it is possible, without departing from the framework of the invention, to imagine other variants and refinements of detail, and similarly consider the use of equivalent means.

The invention claimed is:

1. An electrical switching device, comprising:

a permanent magnet that creates a magnetic field;

a microswitch including a moving element driven by a magnetic effect between at least two states by being aligned according to two different orientations of field lines of the magnetic field of the permanent magnet, wherein the microswitch and the permanent magnet are fixed relative to each other;

a moving ferromagnetic part configured to move between two positions in a direction perpendicular to a direction of magnetization of the permanent magnet and displace a plane of symmetry of the field lines generated with respect to the moving element by the permanent magnet to impose on the moving element one or other of its two states, wherein a direction of displacement of the plane of the symmetry corresponds to the direction of movement of the ferromagnetic part, wherein in an initial position, the ferromagnetic part is maintained by a magnetic effect to be in physical contact against the permanent magnet and at least a portion of the ferromagnetic part is above and parallel to the permanent magnet.

2. A device according to claim 1, wherein the movement of the ferromagnetic part is performed in a direction perpendicular to a rotation axis of the moving element.

3. A device according to claim 1, wherein the microswitch is centered relative to the permanent magnet.

4. A device according to claim 3, wherein, in a second position, the ferromagnetic part is maintained by a magnetic attraction effect exerted by the permanent magnet.

5. A device according to claim 3, wherein the ferromagnetic part has a U-shape comprising a central part and two parallel wings between which the permanent magnet is positioned.

6. A device according to Claim 5, wherein, in each of the positions of the ferromagnetic part, one of its wings is attracted by the permanent magnet.

7. A device according to claims 1, wherein the microswitch is off-centered relative to the permanent magnet.

8. A device according to claim 7, wherein the ferromagnetic part can be displaced between two extreme positions, a stable position in which the ferromagnetic part is maintained by magnetic attraction effect exerted by the permanent magnet and an ephemeral end-stop position in which the ferromagnetic part remains under magnetic influence of the permanent magnet.

9. A device according to claim 1, employed in a pushbutton, a slide button, a position switch, an impact sensor, or an acceleration sensor.

10. A device according to claim 1, wherein, in a second position, the ferromagnetic part is maintained by a magnetic attraction effect exerted by the permanent magnet.

11. A device according to claim 1, wherein the ferromagnetic part has a U-shape comprising a central part and two parallel wings between which the permanent magnet is positioned.

12. A device according to claim 11, wherein, in each of the positions of the ferromagnetic part, one of its wings is attracted by the permanent magnet.

13. An electrical switching device, comprising:

a permanent magnet that creates a magnetic field;

a microswitch including a moving element driven by a magnetic effect between at least two states by being aligned according to two different orientations of field lines of the magnetic field of the permanent magnet, wherein the microswitch and the permanent magnet are fixed relative to each other;

a moving ferromagnetic part that is moved between two positions to act on the orientation of the field lines generated with respect to the moving element by the permanent magnet to impose on the moving element one or other of its two states, wherein the permanent magnet is in a form of a disk and the moving ferromagnetic part has a shape of a rotating ring formed around the permanent magnet and performing a rotation movement about the permanent magnet.

14. A device according to claim 13, wherein the ring presents a protuberance configured to assume two diametrically opposed positions.

15. A device according to claim 13, employed in a rotary knob, a position switch, an impact sensor, or an acceleration sensor.

* * * * *